US008348416B2

(12) United States Patent
Ozaki et al.

(10) Patent No.: US 8,348,416 B2
(45) Date of Patent: Jan. 8, 2013

(54) PRINTING APPARATUS

(75) Inventors: Kazuma Ozaki, Okaya (JP); Kazuya Nomura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 156 days.

(21) Appl. No.: 12/889,187

(22) Filed: Sep. 23, 2010

(65) Prior Publication Data

US 2011/0074872 A1 Mar. 31, 2011

(30) Foreign Application Priority Data

Sep. 25, 2009 (JP) ..... 2009-221293
Mar. 17, 2010 (JP) ..... 2010-060904

(51) Int. Cl.
*B41J 2/01* (2006.01)

(52) U.S. Cl. ..... 347/104; 347/16

(58) Field of Classification Search ..... None
See application file for complete search history.

(56) References Cited

U.S. PATENT DOCUMENTS

2007/0291096 A1 12/2007 Toyoshima

FOREIGN PATENT DOCUMENTS

| | | |
|---|---|---|
| JP | 2006-021475 | 1/2006 |
| JP | 2006-198806 | 8/2006 |
| JP | 2007-098936 A | 4/2007 |
| JP | 2008-254218 | 10/2008 |
| JP | 2009-119778 | 6/2009 |

OTHER PUBLICATIONS

Machine translation and Abstract of JP 2006-021475 A.*

* cited by examiner

*Primary Examiner* — Matthew Luu
*Assistant Examiner* — Justin Seo
(74) *Attorney, Agent, or Firm* — Workman Nydegger

(57) ABSTRACT

A printing apparatus includes a printing medium support unit supporting a printing medium supplied to a print execution area and guiding the transported printing medium. The printing medium support unit includes a support portion supporting the printing medium and defining a predetermined gap between a print head and the support portion. A suction hole disposed in a width direction of the printing medium adsorbs and supports the printing medium on the support portion by applying a suction force to the printing medium. A first recess portion with an ink discharge port is disposed at a position corresponding to a position at an edge of the printing medium of a size which is supposed to be used and receives ink possibly discarded upon executing marginless printing. A first communication passage applies some of the suction force to the first recess portion in a passage independent from the ink discharge port.

14 Claims, 16 Drawing Sheets

PRINTING APPARATUS

BACKGROUND

1. Technical Field

The present invention relates to a printing apparatus that includes a suction hole adsorbing and supporting a printing medium in a printing medium support unit supporting the printing medium supplied to a print execution area and a recess portion receiving and recovering ink discarded upon executing marginless printing.

2. Related Art

An ink jet printer which is an example of a printing apparatus will be described below. Among ink jet printers, there is an ink jet printer including a suction groove adsorbing and supporting a printing medium (hereinafter, also referred to as a "sheet") in a printing medium support unit (hereinafter, also referred to as a "sheet support unit") supporting the sheet supplied to a print execution area in order to stabilize the position of the sheet, as disclosed in JP-A-2007-98936 and JP-A-2008-254218.

Among ink jet printers, there is an ink jet printer capable of executing so-called marginless printing on the entire print surface of a sheet. In such an ink jet printer, ink receiving portions (recess portions) are disposed to receive and recover the ink discarded at the positions corresponding to the standard size of a sheet upon executing the marginless printing (see JP-A-2008-254218).

The suction groove may have various forms, as disclosed in JP-A-2007-98936 and JP-A-2008-254218, but the configuration and function of the suction groove are not considerably different between apparatuses. The sheet is adsorbed and supported by the suction force from the suction hole formed in the bottom of the suction groove and a negative pressure generated by blocking of the upper surface of the suction groove by the sheet supplied onto the suction groove.

The ink is received in the way disclosed in JP-A-2008-254218. A recovery opening is formed on the bottom of the ink receiving portion, and the opening is connected to a suction source via a communication passage. The ink possibly discarded in the ink receiving portion is received and discharged by a negative pressure suction force of the suction force, and is guided to a waste ink storage portion. Since the negative pressure suction force is applied to the ink receiving portion, the sheet sent onto the ink receiving portion is adsorbed and supported by the negative pressure.

In an ink jet printer including a sheet supporting unit having the suction hole and the ink receiving portion which is not connected to the suction source, the sheet may not be adsorbed and supported in the ink receiving portion. For this reason, the suction force applied to a sheet which may vary in size may become unbalanced in a sheet width direction. This is because since most of the ink receiving portions are disposed on the side of an individual edge opposite to a reference edge used to position the sheet in the sheet width direction, a difference in the suction force between the reference edge of the sheet and the individual edge is increased with an increase in the size of the sheet.

When the suction force is unbalanced, as mentioned above, the sheet supported on the support surface of the sheet supporting unit may be skewed (inclined) or the sheet in the ink receiving portions may not be sufficiently adsorbed or supported. Therefore, a problem may arise in that the sheet floats or the like. Moreover, print execution quality may deteriorate or the sheet may not be transported appropriately.

On the other hand, since the suction force of the suction source is applied to the ink receiving portion via the long communication passage and the opening in the configuration (see JP-A-2008-254218) in which the ink receiving portion is connected to the suction source via the opening, the negative pressure necessary for the ink receiving portion is hardly generated. Moreover, a problem may arise in that the opening may be narrowed since the ink near the entrance of the opening may dry and stick.

SUMMARY

An advantage of some aspects of the invention is that it provides a printing apparatus that includes a suction hole adsorbing and supporting a printing medium in a printing medium support unit and a recess portion receiving and recovering ink discarded upon executing marginless printing, and that is capable of reliably adsorbing and supporting the printing medium relative to the support surface of the printing medium support unit by applying a suction force appropriate for the printing medium with good balance regardless of a difference in the size of the printing medium.

According to a first aspect of the invention, there is provided a printing apparatus including a printing medium support unit supporting a printing medium supplied to a print execution area and guiding the printing medium being transported. The printing medium support unit includes: a support portion supporting the printing medium supplied to the print execution area and defining a predetermined gap between a print head and the support portion; a suction hole disposed in a width direction of the printing medium and adsorbing and supporting the printing medium on the support portion by applying a suction force to the printing medium; a first recess portion disposed at a position corresponding to a position at an edge of the printing medium of a size which is supposed to be used, receiving ink possibly discarded upon executing marginless printing, and having an ink discharge port; and a first communication passage applying some of the suction force to the first recess portion in a passage independent from the ink discharge port.

According to this aspect, since the first communication passage applying some of the suction force to the first recess portion in the passage independent from the ink discharge port is connected to the first recess portion, the negative pressure necessary for the first recess portion can be reliably generated. Therefore, by applying the necessary suction force to the printing medium with good balance regardless of a difference in the size of the printing medium, it is possible to reliably adsorb and support the printing medium on the support surface of the printing medium support unit.

Since the ink is prevented from being dried and stuck near the entrance of the ink discharge port of the first recess portion, the ink discharge port may not be narrowed or blocked.

Therefore, since the printing medium is adsorbed and supported on the support portion in the width direction with good balance, skew is prevented from occurring and thus the printing can be executed with good quality. Since floating of the printing medium can be prevented in the region where the first recess portion is formed, it is possible to prevent transport failure such as touching of the printing medium with the print head or blocking of the printing medium.

According to a second aspect of the invention, there is provided a printing apparatus including a printing medium support unit supporting a printing medium supplied to a print execution area and guiding the printing medium being transported. The printing medium support unit includes: a support portion supporting the printing medium supplied to the print execution area and defining a predetermined gap between a print head and the support portion; a suction hole disposed in a width direction of the printing medium and adsorbing and supporting the printing medium on the support portion by applying a suction force to the printing medium; a first recess portion disposed at a position corresponding to a position at an edge of the printing medium of a size which is supposed to be used and receiving ink possibly discarded upon executing marginless printing; and a first communication passage disposed in an entrance of the first recess portion facing the printing medium and applying some of the suction force to the first recess portion.

According to this aspect of the invention, the same advantages as those of the above aspect can be obtained.

According to a third aspect of the invention described in the printing apparatus according to the first and second aspects, the suction hole may be formed in a second recess portion in which a negative pressure space is formed when the printing medium is supplied. The first communication passage may be formed in a partition wall partitioning the first and second recess portions.

According to this aspect, the second recess portion of which the opening area is larger than that of the suction hole is formed. Therefore, the operation area where the suction force is applied to the printing medium can be expanded without increasing the number of suction holes. Accordingly, since the position of the absorbed and supported printing medium can become more stable, it is possible to improve the print execution quality. Moreover, since the first communication passage forms a part of the partition wall partitioning the first and second recess portions, it is possible to distribute the absorbing force from the second recess portion to the first recess portion without modifying the shape or disposition structure of the ink absorbing material.

According to a fourth aspect of the invention described in the printing apparatus according to the third aspect, the printing medium support unit further may include a third recess portion in which a negative pressure space is formed when the printing medium is supplied. A second communication passage applying some of the suction force to the third recess portion may be formed in a partition wall partitioning the second and third recess portions.

According to this aspect, since some of the suction force generated in the suction hole of the second recess portion can be applied to the adjacent third recess portion, it is possible to apply the necessary suction force to the printing medium supported by the printing medium support unit with good balance. Moreover, it is possible to reduce the number of suction holes formed in the printing medium support unit. Accordingly, when the ink is erroneously ejected to the printing medium support unit, the ink can be prevented from flowing in the printing apparatus via the suction hole.

According to a fifth aspect of the invention described in the printing apparatus according to any one of the first to fourth aspects, the first recess portion may include an ink discharge port discharging the possibly discarded ink from the first recess portion and a recovery passage guiding the ink discharged in the ink discharge port to a waste liquid tank. When the printing medium is supplied to a region of the first recess portion, enclosed spaces may be defined among the inside of the first recess portion, the recovery passage, and the waste liquid tank.

According to this aspect, the enclosed spaces are defined among the inside of the first recess portion, the recovery passage, and the waste liquid tank, since the upper surface below the opening of the first recess portion is blocked by the printing medium. Therefore, the negative pressure is generated in the first recess portion. Since the suction force is applied to the printing medium in the region where the first recess portion is formed by the negative pressure and thus an adsorbing and supporting force is generated, the position of the printing medium can become stable.

According to a sixth aspect of the invention described in the printing apparatus according to the fifth aspect, the enclosed spaces may be defined independently in each first recess portion.

According to this aspect, since the enclosed space is defined independently in each first recess portion, the suction force from one pair of first recess portions and the suction force from the suction hole are separately applied to the printing medium. Therefore, the suction force can be applied to all of the first recess portions and the suction holes in which the upper surfaces of the openings are blocked by the upper surface of the printing medium. That is, even when there are the openings of upper surfaces which are not completely blocked in parts of the first recess portion and the suction hole, the suction force is maintained in the first recess portion and the suction hole in which the openings of the upper surfaces are completely blocked, and thus the desired adsorption and support state can be realized.

According to a seventh aspect of the invention described in the printing apparatus according to the fifth or sixth aspect, the waste liquid tank may be filled with an ink absorbing member absorbing the ink guided from the recovery passage. The enclosed spaces defined in the waste liquid tank may be formed in a void portion between an ink introduction portion connected to the recovery passage and the ink absorbing member.

According to this aspect, the enclosed space is formed in the ink introduction portion separately communicating with each first recess portion through the ink absorbing member densely disposed in the waste liquid tank, even when a partition chamber separately communicating with the first recess portion and partitioned by a partition wall is formed in the waste liquid tank. Therefore, the suction force can be applied to the separate first recess portion without modifying the structure of the waste liquid tank.

According to an eighth aspect of the invention described in the printing apparatus according to any one of the fifth to seventh aspects, the waste liquid tank may be disposed in a cartridge type waste liquid box detachably mounted on a printing apparatus main body. A connection structure connecting the waste liquid tank and the recovery passage to each other in an enclosed state may be disposed in a connection portion of the waste liquid tank and the recovery passage.

According to this aspect, the maintenance of the waste liquid tank can be improved. Since air tightness and liquid tightness are achieved between the waste liquid tank and the recovery passage by the communication structure upon mounting the waste liquid tank, the adsorbed and supported position of the printing medium can become stable, while the waste liquid tank can be handled easily. Accordingly, the print execution quality can be improved and the printing medium can be transported satisfactorily.

According to a ninth aspect of the invention described in the printing apparatus according to the eighth aspect, the connection structure may include: an inclination connection portion of which a joint surface is formed as an inclination surface and which is disposed at a discharge end of the recovery passage; an inclination joint portion which is disposed in an ink introduction portion of the waste liquid tank in which a joint surface is formed as the inclination surface so as to join to the joint surface of the inclination connection portion; and a seal member which is disposed in either or both of the inclination connection portion and the inclination joint portion.

According to this aspect, the waste liquid tank and the recovery passage can be strongly connected to each other by the joint operation of the wedge shape of the inclination connection portion and the inclination joint portion without employing a complex connection structure. Moreover, by using the seal member, the air tightness and liquid tightness can be further improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus according to the following embodiments of the invention will be described in detail with reference to the accompanying drawings. An ink jet printer 1 is used as an example of the printing apparatus according to the invention. The overall inner configuration of the ink jet printer 1 will be described.

The illustrated ink jet printer 1 is an ink jet printer that is capable of executing printing on both sheets P of a roll sheet and a single sheet with a predetermined standard size.

Figure 1:
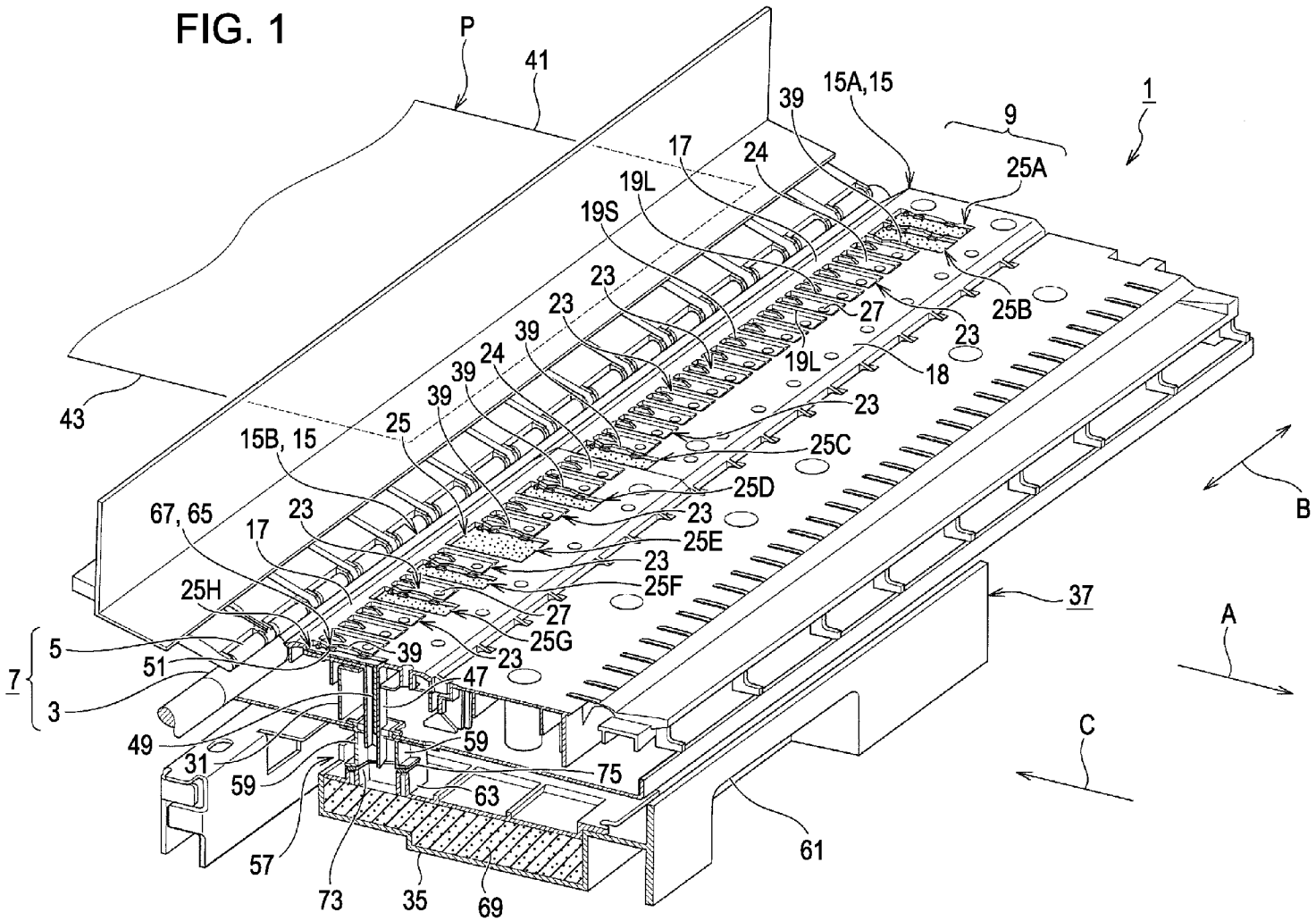
FIG. 1 is a cutaway perspective view illustrating the periphery of a sheet support unit of an ink jet printer according to an embodiment of the invention.
Figure 2:
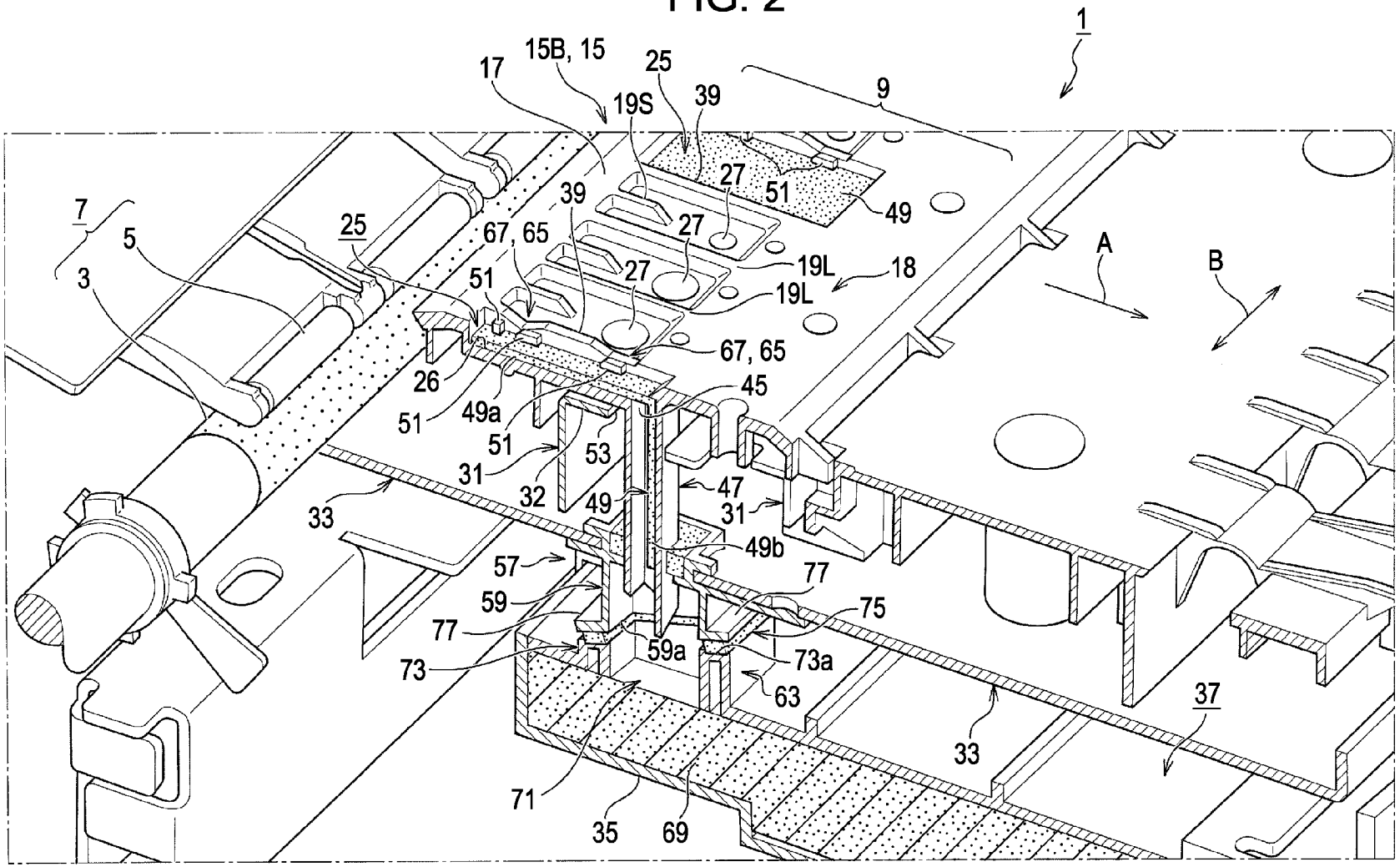
FIG. 2 is an enlarged perspective cutaway view illustrating one pair of first recess portions, a recovery passage, and a waste liquid tank according to the embodiment of the invention.
Figure 3:
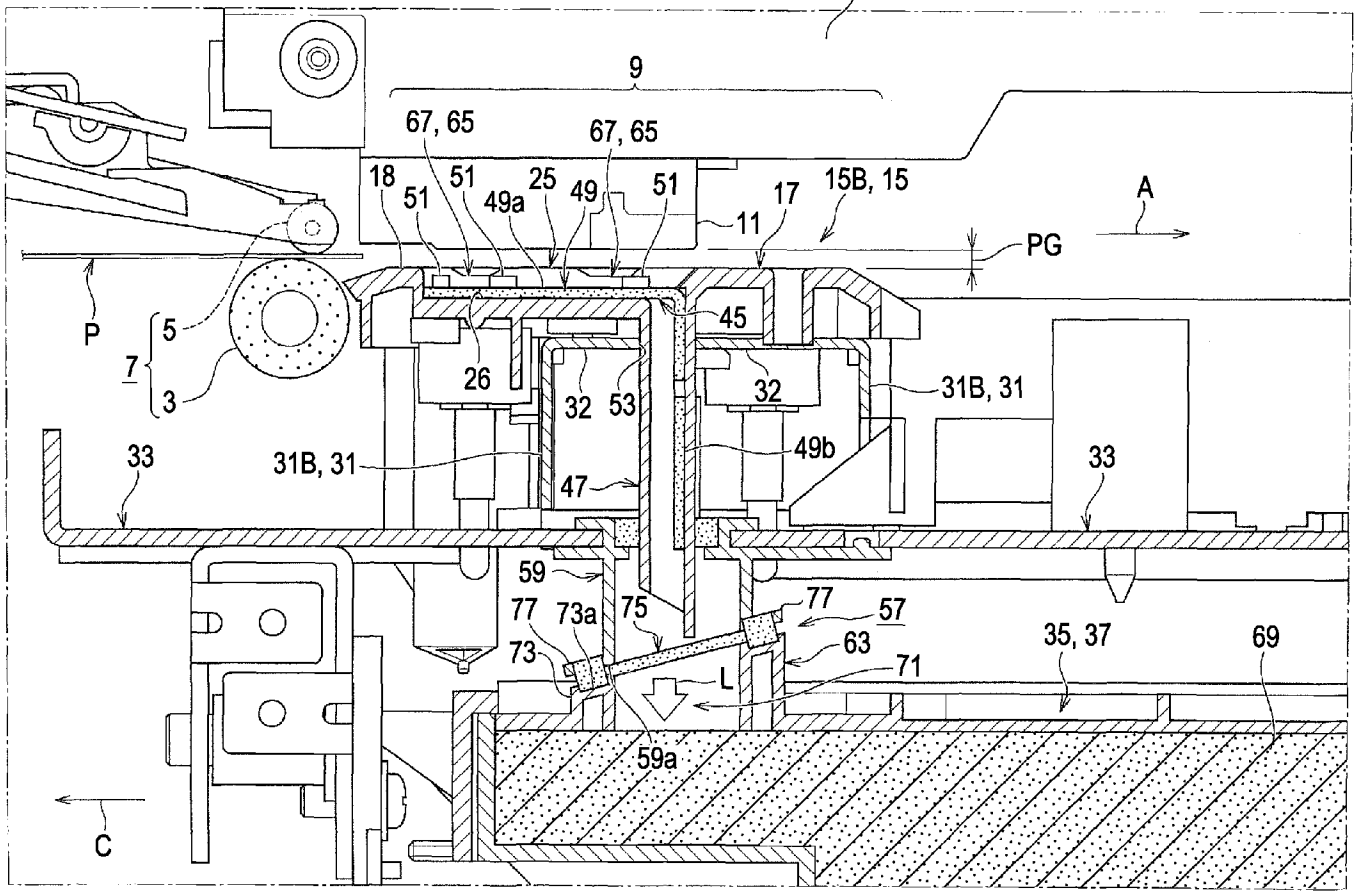
FIG. 3 is a side sectional view illustrating the periphery of the sheet support unit of the ink jet printer according to the embodiment of the invention.
Figure 4:
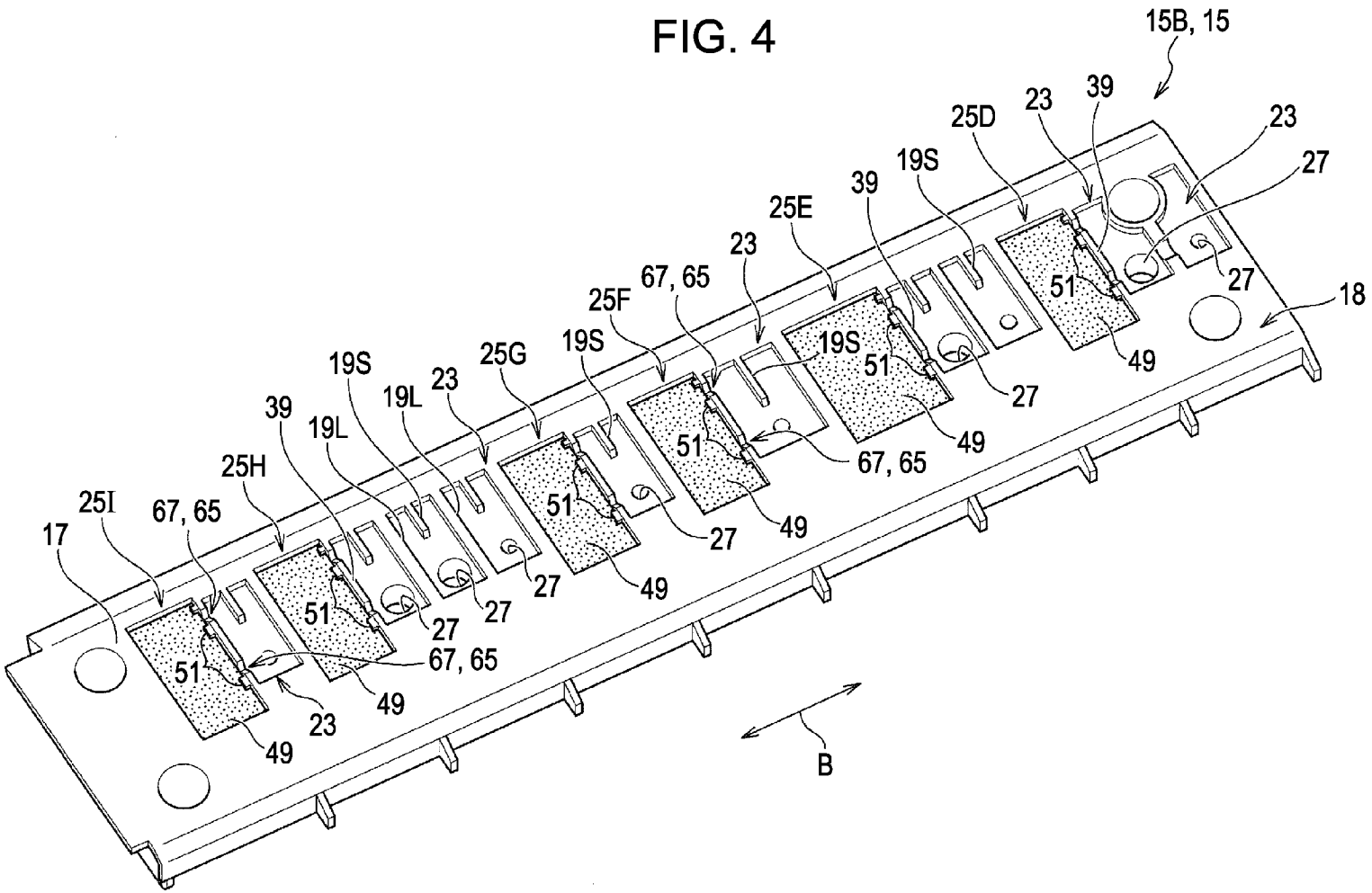
FIG. 4 is a perspective view illustrating the sheet support unit on the side of an individual edge of a sheet when viewed from an upper side of inclination according to the embodiment of the invention.

As shown in FIGS. 1 to 3, a print execution area 9 is provided at the position of transport rollers 7, which includes a pair of transport driving roller 3 and a transport driven roller 5, on the downstream side in a transport direction A.

For example, a print head 11 executing printing of ejecting ink to a print surface of a sheet P is disposed above the print execution area 9. For example, the print head 11 is mounted on a carriage 13 reciprocating in a width direction B of the sheet P intersecting the transport direction A of the sheet P.

For example, a cartridge type waste box 37 which can be detachably mounted is disposed below the print execution area 9. The cartridge type waste liquid box 37 includes: a sheet support unit 15 serving as a printing medium support unit supporting the sheet P supplied to the print execution area 9 and guiding the sheet P being transported; a retention frame 31 retaining the sheet support unit 15 and disposed on the rear surface of the sheet support unit 15; a support unit fixing plate 33 fixing the sheet support unit 15 and the retention frame 31 to a printer main body (not shown) serving as a printing apparatus main body; and a waste liquid tank 35 storing ink L recovered by ink discard grooves 25 as an example of a first recess portion, which is described below.

The sheet support unit 15 is a member with a long rectangular shape in the width direction B in a plan view. In this embodiment, for example, the sheet support unit 15 includes two members, which are combined with each other in an interlocking manner, that is, a reference-side sheet support unit 15A disposed on the side of the reference edge (see FIG. 1) of the sheet P and an individual-side sheet support unit 15B disposed on the side of an individual edge 43 (side opposite to the reference edge 41) individually determined depending on the size of the sheet P. A support portion 17 coming into direct contact with the sheet P supplied to the print execution area 9 and defining a predetermined gap PG with the print head 11 is disposed on the surface of the sheet support unit 15. In the illustrated ink jet printer 1, parts of the support portion 17 are formed by support ribs 19 extending in the transport direction A. The support ribs 19 are formed as a plurality of lines formed at an appropriate interval in the width direction B.

For example, the support ribs 19 include support ribs 19S having a short length and guiding the sheet P onto a suction hole 27, which is described below, and support ribs 19L having a long length and disposed on the right and left sides of the support ribs 19S having the short length.

The suction grooves 23 and the ink discard grooves 25 are arranged in predetermined order in the width direction B by the support ribs 19L having the long length and partition walls 39, which are described below.

At the right end of the reference-side sheet support unit 15A on the diagonally upward right side of FIG. 1, two ink discard grooves 25A and 25B are disposed at the positions corresponding to the passage position of the reference edge 41 used to position the sheet P in the width direction B. At the left end of the reference-side sheet support unit 15A, another single ink discard groove 25C is disposed at the position corresponding to the passage position of the individual edge 43 of the sheet P with the minimum size which is supposed to be subjected to marginless printing.

The plurality of suction grooves 23, which are an example of a second recess portion, is continuously arranged between the ink discard groove 25B and the ink discard groove 25C in the state where the suction grooves 23 are partitioned by the support ribs 19L.

On the other hand, in the individual-side sheet support unit 15B on the diagonally downward left side of FIG. 1, six ink discard grooves 25D, 25E, 25F, 25G, 25H, and 25I according to this embodiment are disposed at the positions corresponding to the passage position of the individual edge 43 of the sheet P with a standard size larger than the minimum size which is supposed to be used. The plurality of suction grooves 23 are respectively disposed between the ink discard grooves 25D, 25E, 25F, 25G, 25H, and 25I at a distance from the partition walls 39 in the state where the suction grooves 23 are partitioned by one support rib or the support ribs 19L having the long length.

The suction groove 23 is a recess portion which has a rectangular shape in a plan view, for example, and has a predetermined depth. In the suction groove 23, an enclosed space is formed therein when the sheet P is supplied and the opening of the upper surface is blocked. The suction hole 27 connected to one end of a suction passage 29 is formed in the middle or the like of the bottom 24 of the suction groove 23. A suction source (not shown) formed by a suction fan or the like generating a suction force S is connected to the other end of the suction passage 29.

The ink discard groove 25 is a recess portion which has a rectangular shape in a predetermined depth in a plan view and which recovers ink L possibly discarded upon executing so-called marginless printing to print an image across the entire print surface of the sheet P. An ink discharge port 45 discharging the possibly discarded ink L from the ink discard groove 25 is formed on the bottom 26 of the ink discard groove 25. A recovery passage 47 guiding the discharged ink L to the waste liquid tank 35 and extending downward is connected to the ink discharge port 45.

An ink absorbing material 49, which absorbs the ink L possibly discarded upon executing the marginless printing and guiding the absorbed ink to the recovery passage 47, is received in the ink discard groove 25. The ink absorbing material 49 is a member with a rectangular plate shape. As shown in FIG. 3, the ink absorbing material 49 is received in a bent form of an L shape in a side view so that a base end portion 49*a* of the ink absorbing material 49 is located in the ink discard groove 25 and a front end portion 49*b* of the ink absorbing material 49 is located in the recovery passage 47.

A plurality of locking convex portions 51 retaining the base end portion 49*a* of the ink absorbing material 49 received in the ink discard groove 25 is formed inwardly on the side wall of the ink discard groove 25.

Figure 5:
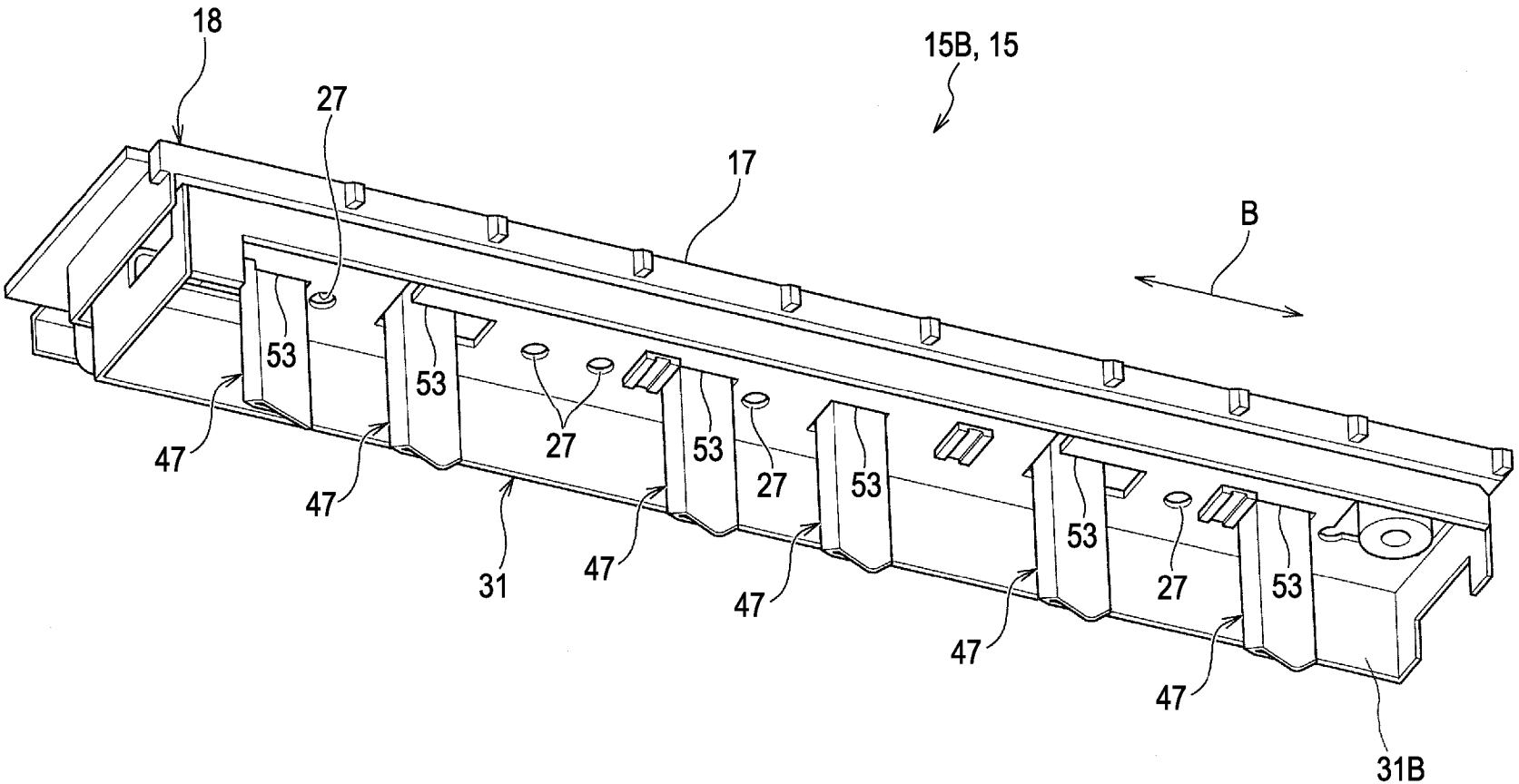
FIG. 5 is a perspective view illustrating the sheet support unit on the side of an individual edge of the sheet and a retention frame when viewed from a lower side of the inclination according to the embodiment of the invention.

As shown in FIGS. 3 and 5, a retention frame 31B retaining the individual-side sheet support unit 15B is disposed on the rear surface of the individual-side sheet support unit 15B. The retention frame 31B is a member with a rectangular shape, for example. Six reception passages 53 receiving the six recovery passages 47 are formed on a top plate 32 of the retention frame 31B attached on the rear surface of the individual-side sheet support unit 15B.

Figure 6:
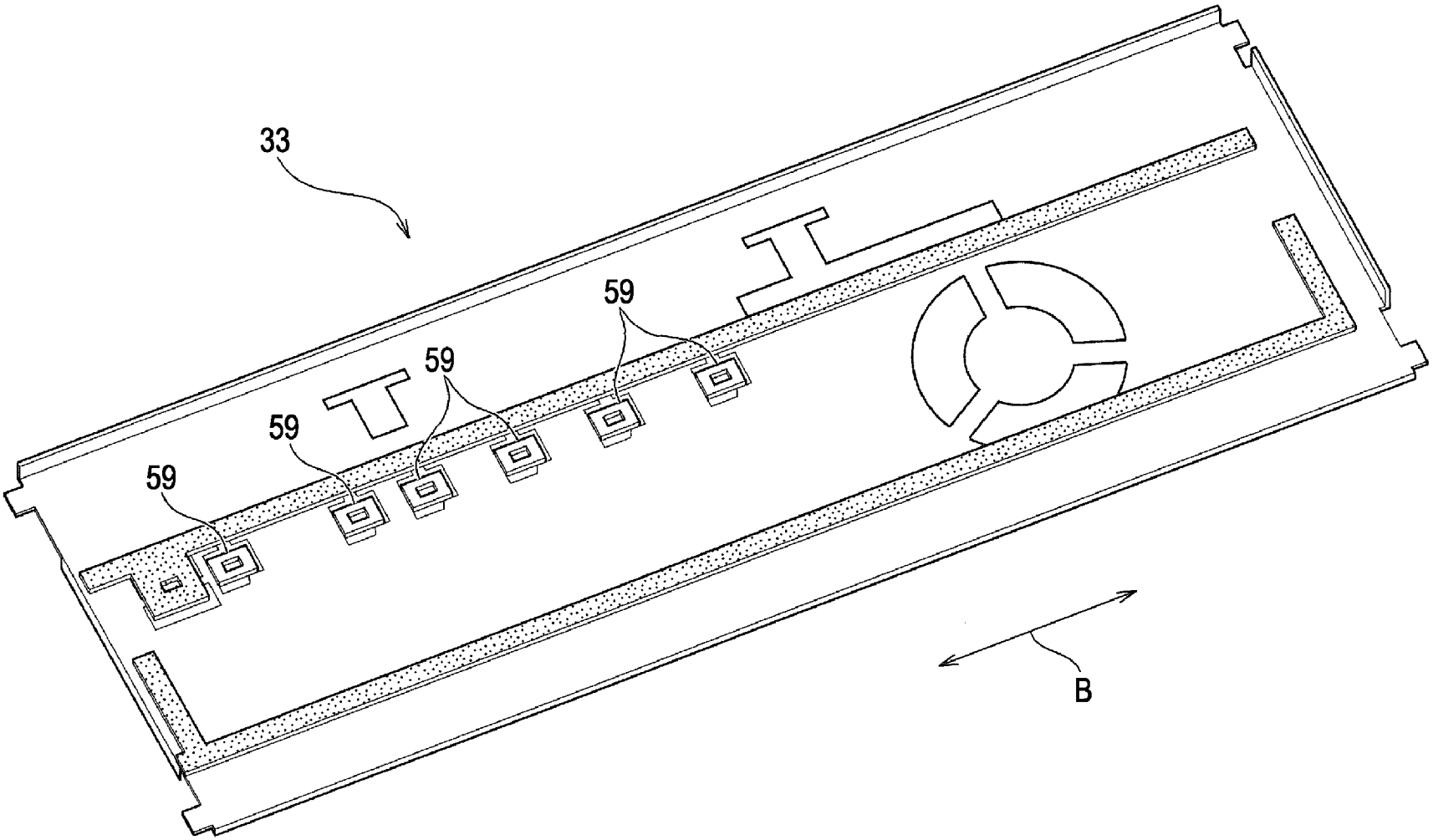
FIG. 6 is a perspective view illustrating a support unit fixing plate when viewed from the upper side of the inclination according to the embodiment of the invention.
Figure 7:
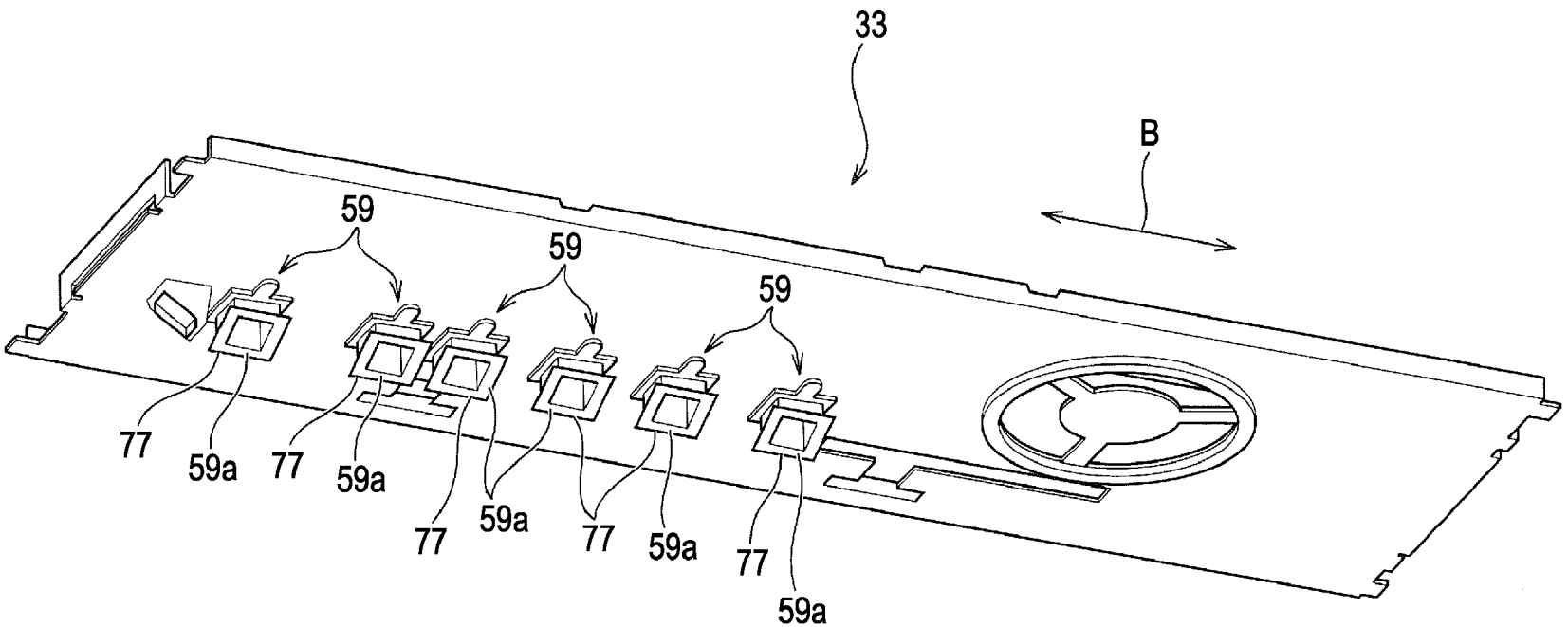
FIG. 7 is a perspective view illustrating the support unit fixing plate and an inclination connection portion when viewed from the lower side of the inclination according to the embodiment of the invention.

As shown in FIGS. 6 and 7, the support unit fixing plate 33 is formed by punching a rectangular plate member made by, for example, metal in a predetermined shape by press-molding and folding the rectangular shape member. An inclination connection portion 59 which is a constituent element of a communication structure 57 described below is mounted on the support unit fixing plate 33.

Figure 8:
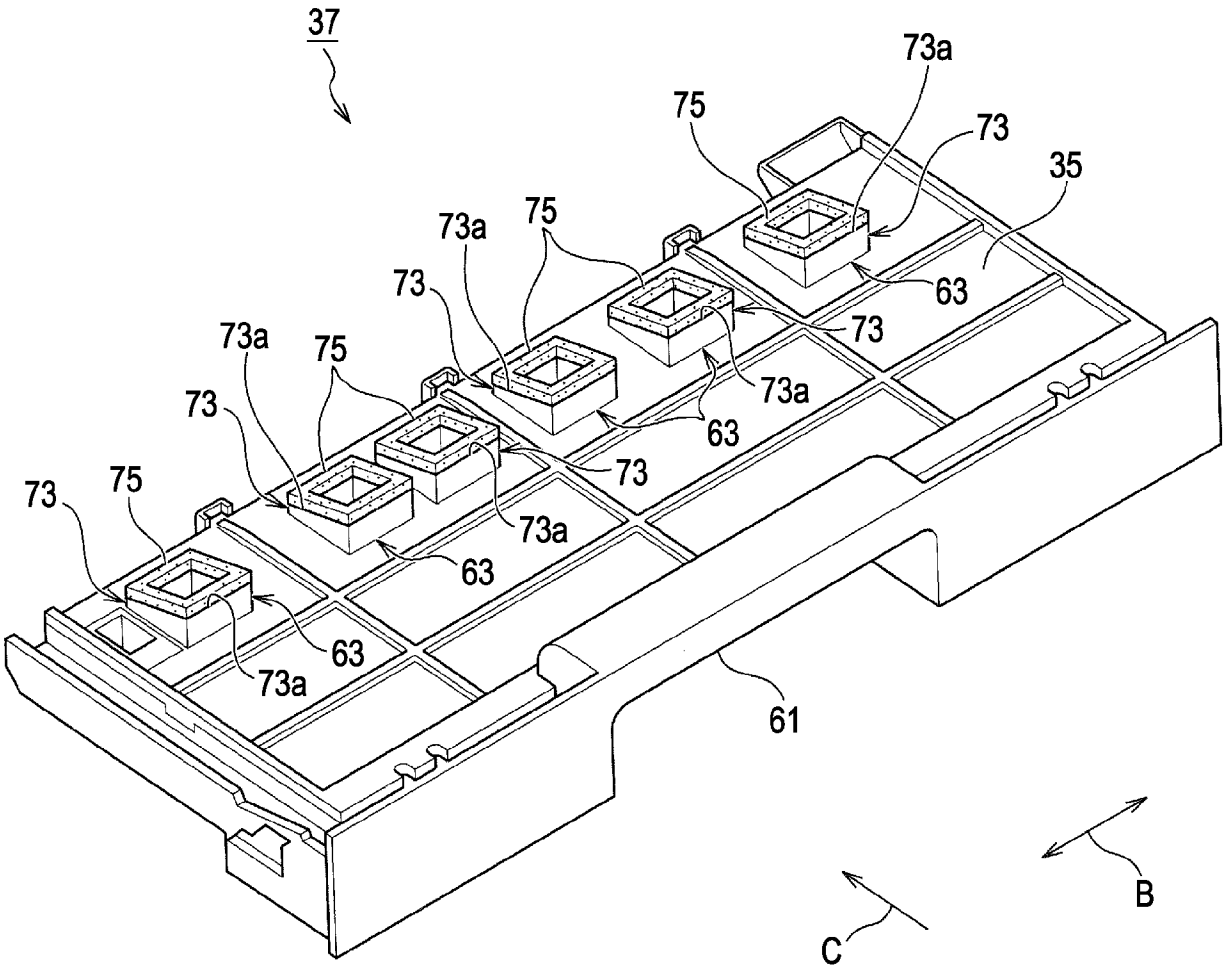
FIG. 8 is a perspective view illustrating a waste liquid box when viewed from the upper side of the inclination according to the embodiment of the invention.
Figure 9:
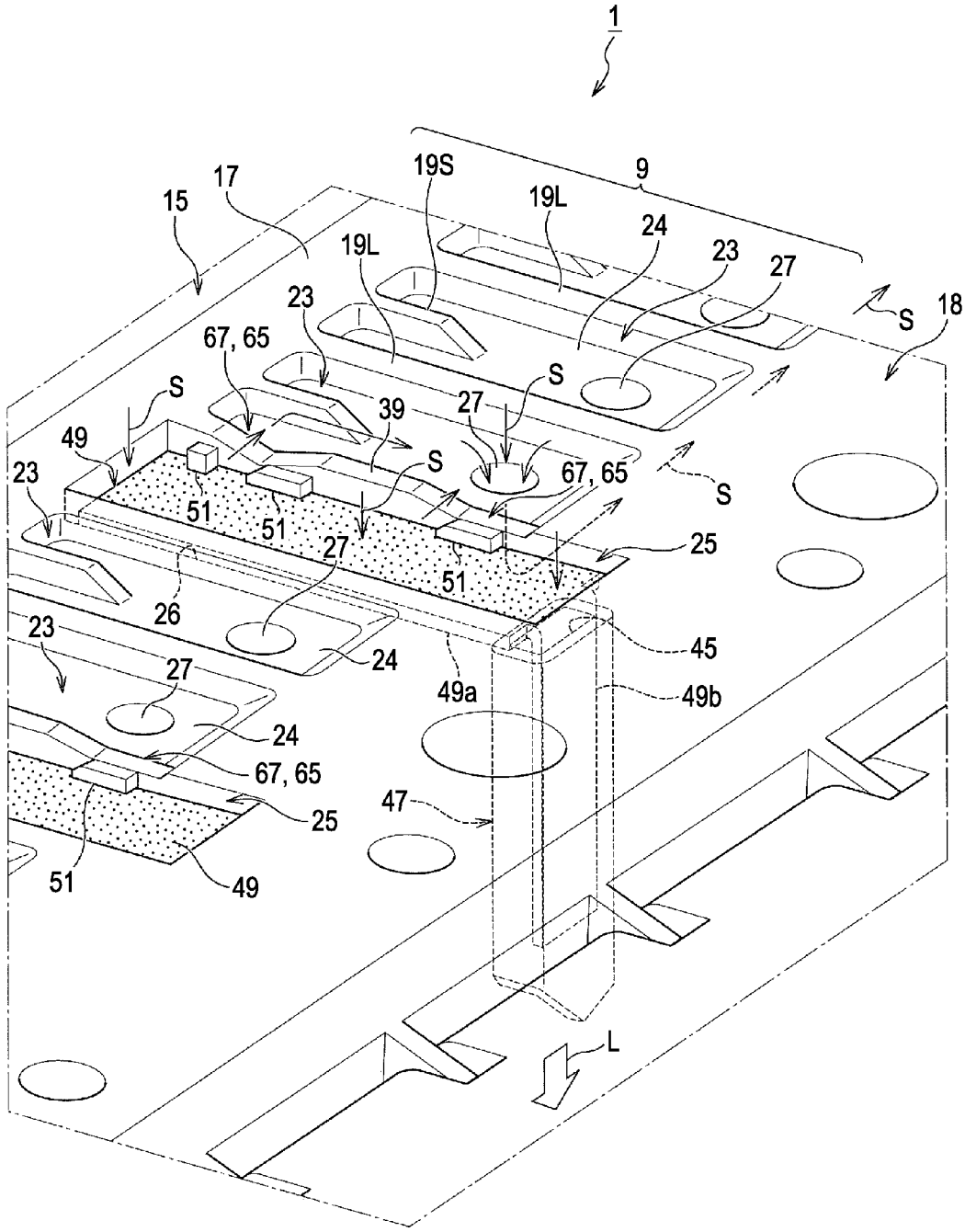
FIG. 9 is an enlarged perspective view illustrating the periphery of one pair of first recess portions and one pair of second recess portions according to the embodiment of the invention.
Figure 10:
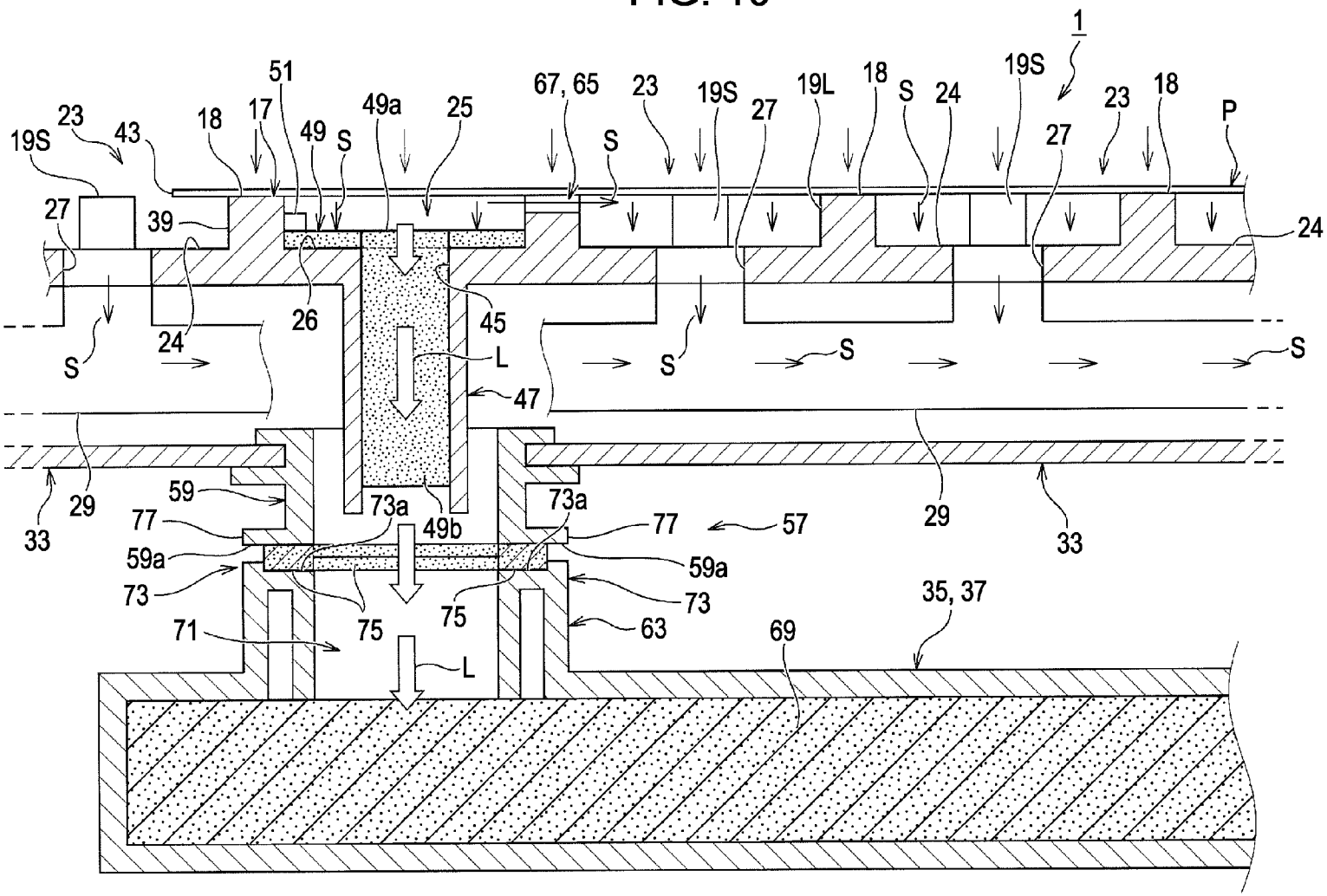
FIG. 10 is a longitudinal sectional front view illustrating the periphery of one pair of first recess portions and one pair of second recess portions according to the embodiment of the invention.

The waste liquid box 37 is a member with a rectangular flat pipe shape, as shown in FIG. 8. A notch portion 61 used upon mounting or detaching the waste liquid box 37 on or from the printer main body (not shown) is formed in the middle of the entire surface of the waste liquid box 37.

The waste liquid tank 35, which is described below, is provided inside the liquid waste box 37. Introduction portions 63, which are described below, for the ink L connected so as to cover the recovery passages 47 are formed in the inside of the waste liquid tank 35.

Embodiment 1 (See FIGS. 1 to 10)

The ink jet printer 1 according to the invention has not only the above-described configuration but also a first communication passage 65 which operates some of the suction force S supplied to the suction hole 27 and is disposed in the ink discard groove 25 in a passage independent from the ink discharge port 45, which is described below.

In this embodiment, for example, two communication grooves 67 are formed by recessing parts of the upper portion of the partition wall 39 partitioning the ink discard groove 25 and the suction hole 23. The two communication grooves 67 form the first communication passage 65. That is, the first communication passage is formed in the entrance of the ink discard groove 25 facing the sheet P to apply some of the suction force to the ink discard groove 25.

The ink discharge port 45 discharging the possibly discarded ink L from the ink discard groove 25, as described above, is formed in the ink discard groove 25. The recovery passage 47 guiding the discharged ink L to the waste liquid tank 35 is connected to the ink discharge port 45. When the sheet P is supplied onto the ink discard grooves 25, the upper surfaces of the ink discard grooves 25 are blocked and thus enclosed spaces blocked from the outside atmosphere are defined among the inside of the ink discard grooves 25, the recovery passage 47, and the waste liquid tank 35.

The enclosed space is independently defined in one pair of ink discard grooves 25. Therefore, the suction force S from the pair of suction holes 27 corresponding to the pair of ink discard grooves 25 is separately applied to the one pair of ink discard grooves 25.

Specifically, since ink absorbing members 69 are densely arranged in the waste liquid tank 35, the circulating air in the ink absorbing members 69 can be very small to the extent that the air is nearly ignored. Therefore, the enclosed space in the waste liquid tank 35 is formed in a void portion 71 between the introduction portion 63 for the ink L connected to the recovery passage 47 and the ink absorbing member 69.

Therefore, in the individual-side sheet support unit 15B, six pairs of enclosed spaces are formed in which no air circulates among the six ink discard grooves 25D, 25E, 25F, 25G, 25H, and 25I and no air circulates among the inside spaces of the ink discard grooves 25 corresponding to the ink discard grooves 25, the recovery passages 47, the introduction portions 63 for the ink L, and the void portion 71.

In the waste liquid tank 35, connection structures 57 connecting the introduction portions 63 and the recovery passages 47 in an enclosed state are separately disposed in connection portions of the six introduction portions 63 for the ink L, for example, and the six recovery passages 47 corresponding to the introduction portions 63, for example.

As shown in FIGS. 6 and 7, the connection structures 57 are mounted on the support unit fixing plate 33. The connection structure 57 includes an inclination connection portion 59 disposed in order to cover the recovery passage 47, as shown in FIG. 3, an inclination joint portion 73 disposed in the introduction portion 63 for the ink L and joining to the inclination connection portion 59, as shown in FIGS. 3 and 8, and a seal member 75 attached to a joint surface 73*a* of the inclination joint portion 73, for example.

The inclination connection portion 59 is an angled tubular member which has a flange 77 inclined downwardly and has a diameter larger than that of the recovery passage 47. The lower surface of the flange 77 is configured as a joint surface 59*a*. The joint surface 59*a* has an inclined surface in which the front region in an insertion direction C of the waste liquid tank 35 is low and the rear region in the insertion direction C of the waste liquid tank 35 is high.

The introduction portion 63 for the ink L is an angled tubular member having a diameter nearly the same as that of the inclination connection portion 59. The upper end of the introduction portion 63 for the ink L is configured as the inclination joint portion 73 joining to the joint surface 59*a* of the inclination connection portion 59.

The joint surface 73*a* which is the upper surface of the inclination joint portion 73 is formed by the inclination surface with the same inclination as that of the joint surface 59*a* of the inclination connection portion 59. The seal member 75 having an angled ring shape and formed of an elastic material such as synthetic gum is attached to four sides of the circumference of the joint surface 73*a*.

Next, the operation of the sheet support unit 15 of the ink jet printer 1 with the above-described configuration will be described as separate operations upon (1) supplying the sheet, (2) sucking the sheet, and (3) recovering the ink.

1. Upon Supplying Sheet (See FIG. 3)

The front end portion of the sheet P pinched by the transport driving roller 3 and the transport driven roller 5 is sent in the transport direction A and is supplied to the print execution area 9. When the front end portion of the sheet P covers the suction grooves 23, the open upper surface of the suction grooves 23 are blocked and thus the inner spaces of the suction grooves 23 are nearly closed.

When the front end portion of the sheet P also covers the ink discard grooves 25, the open upper surfaces of the ink discard grooves 25 are blocked. Therefore, the enclosed spaces are formed among the inner spaces of the ink discard grooves 25, the recovery passages 47, and the ink absorbing members 69 of the waste liquid tank 35.

At this time, since the waste liquid box 37 is mounted on the printer main body (not shown), as shown in FIG. 3, the seal member 75 attached to the joint surface 73*a* of the inclination joint portion 73 on the side of the waste liquid box 37 comes into contact with the joint surface 59*a* of the inclination connection portion 59 on the side of the sheet support unit 15. Therefore, air tightness and liquid tightness are ensured in the connection structure 57.

2. Upon Sucking Sheet (See FIG. 10)

When the suction force S generated by a suction device (not shown) is applied from the suction holes 27 to the suction grooves 23 in this state, the inner spaces of the suction grooves 23 enter a negative pressure state. Therefore, the sheet P blocking the upper surfaces of the suction grooves 23 is sucked toward the bottoms 24 of the suction grooves 23.

When the sheet P is transferred in this state, the sheet P comes into contact with a support surface 18 of the support portion 17 and thus is supported by the support portion. Therefore, the initially occurring curving or curling of the sheet P is corrected and thus the sheet P flattens.

Some of the suction force S supplied to the inner spaces of the suction grooves 23 passes through the communication grooves 67 and is also applied to the inner spaces of the ink discard grooves 25. Therefore, the enclosed spaces between the inner spaces of the ink discard grooves 25 and the void portion 71 corresponding to the waste liquid tank 35 also enter a negative pressure state.

In this way, since the sheet P is sucked not only in the regions where the suction grooves 23 are formed but also in the regions where the ink discard grooves 25 are formed, the sheet P is equally sucked in the width direction B. Therefore, skew is prevented from occurring.

The floating of the sheet P, which occurs in the regions where the ink discard grooves 25 are formed in a known example, is prevented from occurring. Accordingly, since the predetermined gap PG with the print head 11 is maintained, the printing can be executed with high precision and the sheet P can be smoothly transported.

3. Upon Recovering Ink (See FIG. 10)

After the sheet P starts to be sucked and the sheet P is adsorbed and supported on the support surface 18 of the support portion 17, scanning of the carriage 13 and ejection of the ink L from the print head 11 are executed. Then, the printing is executed on the print surface of the sheet P. Upon executing marginless printing, the ink may be discarded not only in the ink discard grooves 25A and 25B located at the pass position of the reference edge 41 of the sheet P, but also in several of the ink discard grooves 25C to 25I located at the pass position of the individual edge 43 of the sheet P.

Since the ink absorbing material 49 is received in each ink discard groove 25, sticking of the ink L, which may occur due to flying of the ink L to the surrounding area or drying of the ink L in the ink discard grooves 25, does not occur.

The ink L possibly discarded in the ink discard grooves 25 reaches the recovery passage 47 from the ink discharge port 45 without receiving the influence of the suction force S. Then, the ink L is discharged into the waste liquid tank 35 via the introduction portion 63 for the ink L, and then is absorbed by the ink absorbing members 69 received in the waste liquid tank 35. Therefore, since the ink is prevented from being dried and stuck near the entrance of the ink discharge port 45 of the ink discard groove 25, the ink discharge port 45 is not narrowed or blocked.

Since the enclosed spaces between the inner spaces of the ink discard grooves 25 and the void portion 71 corresponding to the waste liquid tank 35 come to have a negative pressure, as described above, it is not necessary to accelerate drying of the ink L by applying air to the ink L being recovered.

When a predetermined amount of ink L is accumulated in the ink absorbing members 69, the notch portion 61 of the waste liquid box 37 is grasped with a hand to pull the waste liquid box 37 open. Then, the waste liquid box 37 is detached from the printer main body. At this time, since the joint surface 59*a* of the inclination connection portion 59 and the joint surface 73*a* of the inclination joint portion 73 are the same inclination surfaces, as described above, the waste liquid box 37 can be smoothly detached from the printer main body without large load resistance.

When a new waste liquid box 37 or the waste liquid box 37 from which the ink L is removed is mounted on the printer main body, the notch portion 61 is grasped with the hand to push the waste liquid box 37 in the inward side. Then, the connection structures 57 are joined by the wedge shape of the inclination connection portions 59 and the inclination joint portions 73. Therefore, since the spaces between the ink discard grooves 25 and the void portion 71 become the enclosed spaces, air tightness and liquid tightness are ensured.

The printing apparatus 1 according to the invention basically has the above-described configuration. However, partial modification or omission of the configuration may, of course, be made without departing from the gist of the invention.

Figure 11A:
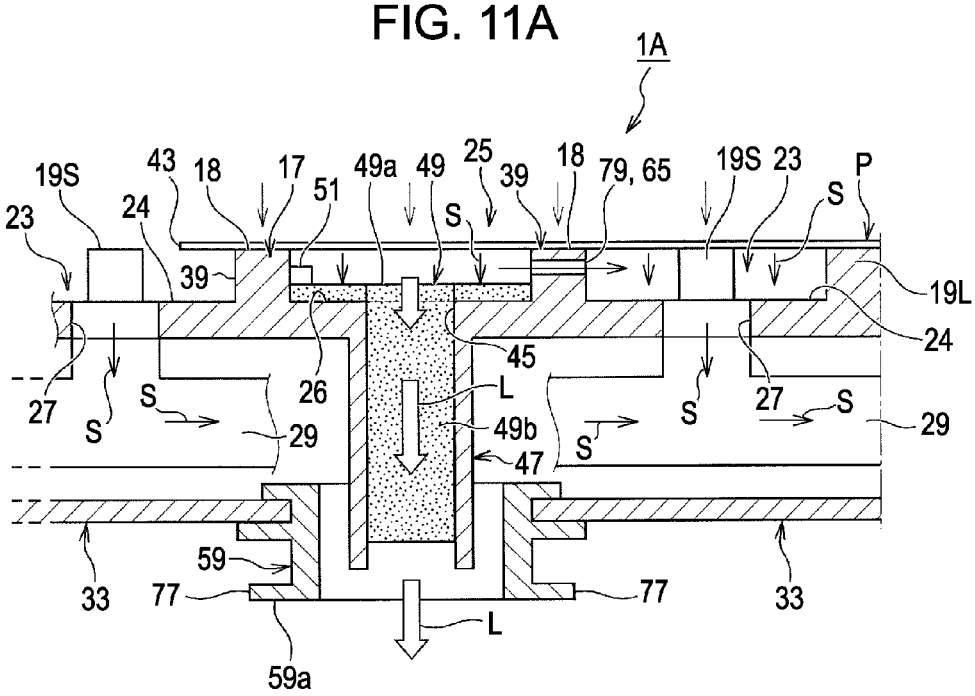
FIGS. 11A and 11B are longitudinal sectional front views illustrating the periphery of one pair of first recess portions and one pair of second recess portions according to another embodiment of the invention.
Figure 11B:
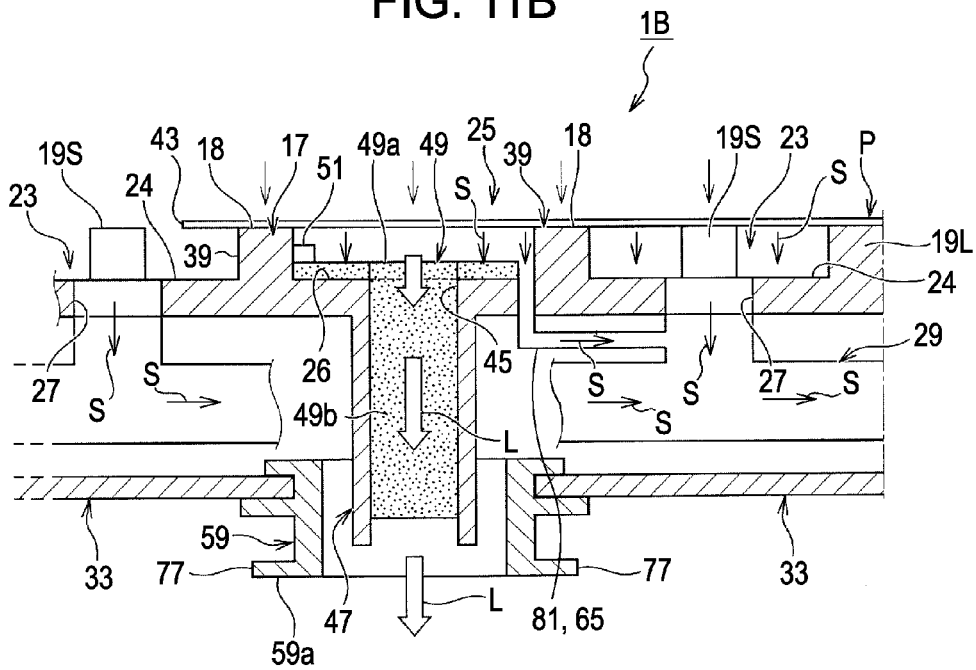

Embodiment 2 (See FIGS. 11A and 11B)

For example, as in ink jet printers 1A and 1B shown in FIGS. 11A and 11B, respectively, the first communication passage 65 may not be formed by the communication grooves 67 formed by recessing the upper portion of the partition wall 39. Instead, as shown in FIG. 11A, a communication hole 79 formed in the middle of the partition wall 39 may form the first communication passage 65.

Alternatively, as shown in FIG. 11B, a communication pipe line 81 connecting the bottom 26 of the ink discard groove 25 to the suction passage 29 extending from the suction hole 27 may form the first communication passage 65.

Figure 12:
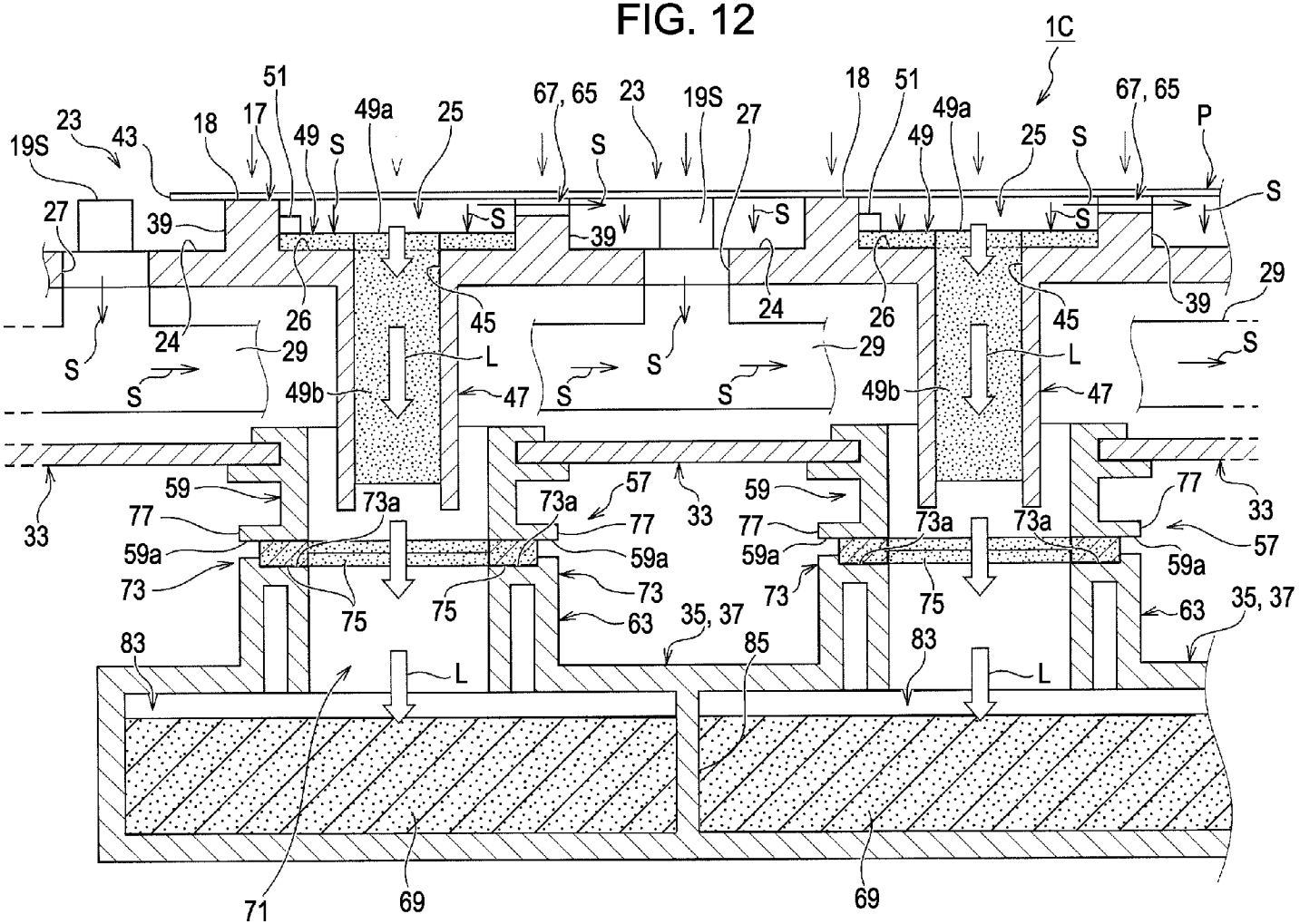
FIG. 12 is a longitudinal sectional front view illustrating the periphery of one pair of first recess portions and one pair of second recess portions according to still another embodiment of the invention.

Embodiment 3 (See FIG. 12)

When the ink absorbing members 69 are not be densely arranged in the waste liquid tank 35 and a gap 83 is formed therebetween, air leakage from the gap 83 may occur. Therefore, it is difficult to form the enclosed space in each ink discard groove 25.

In this case, as in an ink jet printer 1C shown in FIG. 12, by forming a wall 85 partitioning the waste liquid tank 35, air leakage from the gap 83 can be prevented in the adjacent enclosed space.

Figure 13:
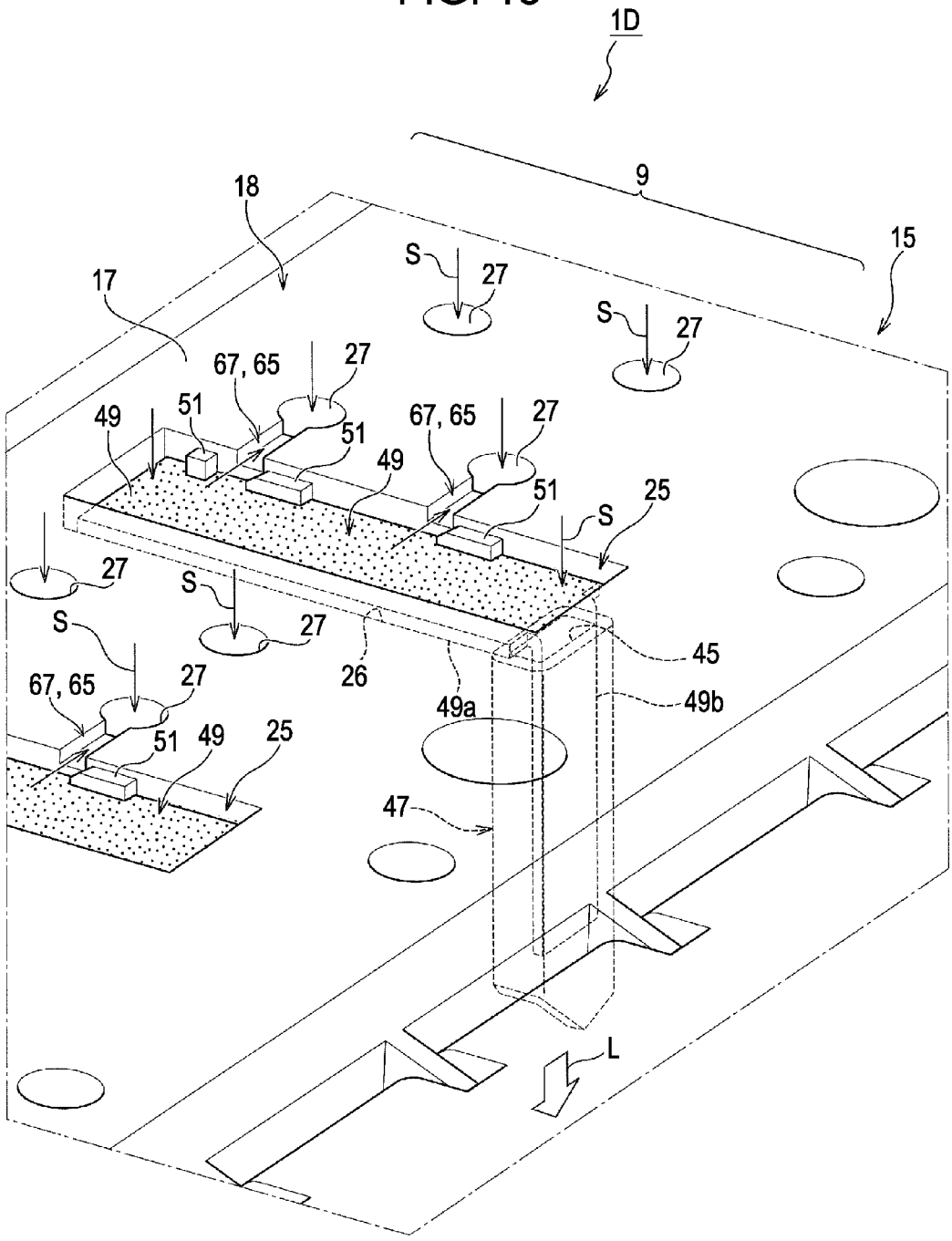
FIG. 13 is an enlarged perspective view illustrating one pair of first recess portions and one pair of suction holes according to still another embodiment of the invention.
Figure 14:
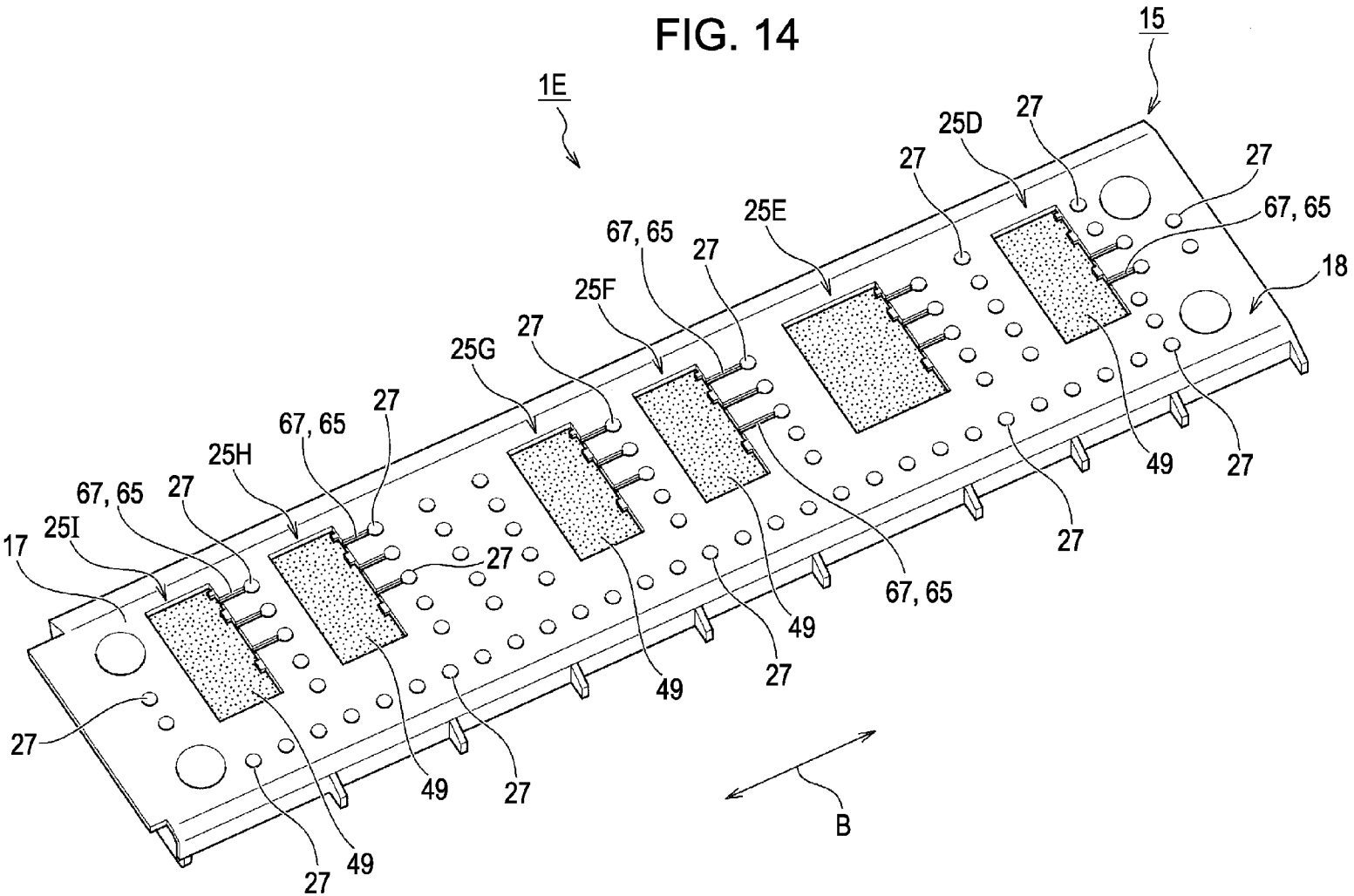
FIG. 14 is a perspective view illustrating a sheet support unit on the side of an individual edge of a sheet when viewed from an upper side of inclination according to still another embodiment of the invention.

Embodiment 4 (See FIGS. 13 and 14)

As in ink jet printers 1D and 1E shown in FIGS. 13 and 14, respectively, the suction holes 27 may be formed directly in the support portion 17 by omitting some or all of the suction grooves 23 formed in the sheet support unit 15.

With such a configuration, as shown in FIGS. 13 and 14, the first communication passage 65 may be formed by the communication groove 67, as in the above-described embodiment. Alternatively, the first communication passage 65 may be formed by the communication hole 79 or the communication pipe line 81 illustrated in FIGS. 11A and 11B.

In this case, by increasing the number of suction holes 27, the plurality of suction holes 27 may be arranged in the entire width of the sheet support unit 15 in the ink jet printer 1E shown in FIG. 14. Accordingly, the position of the sheet P can become more stable.

Figure 15:
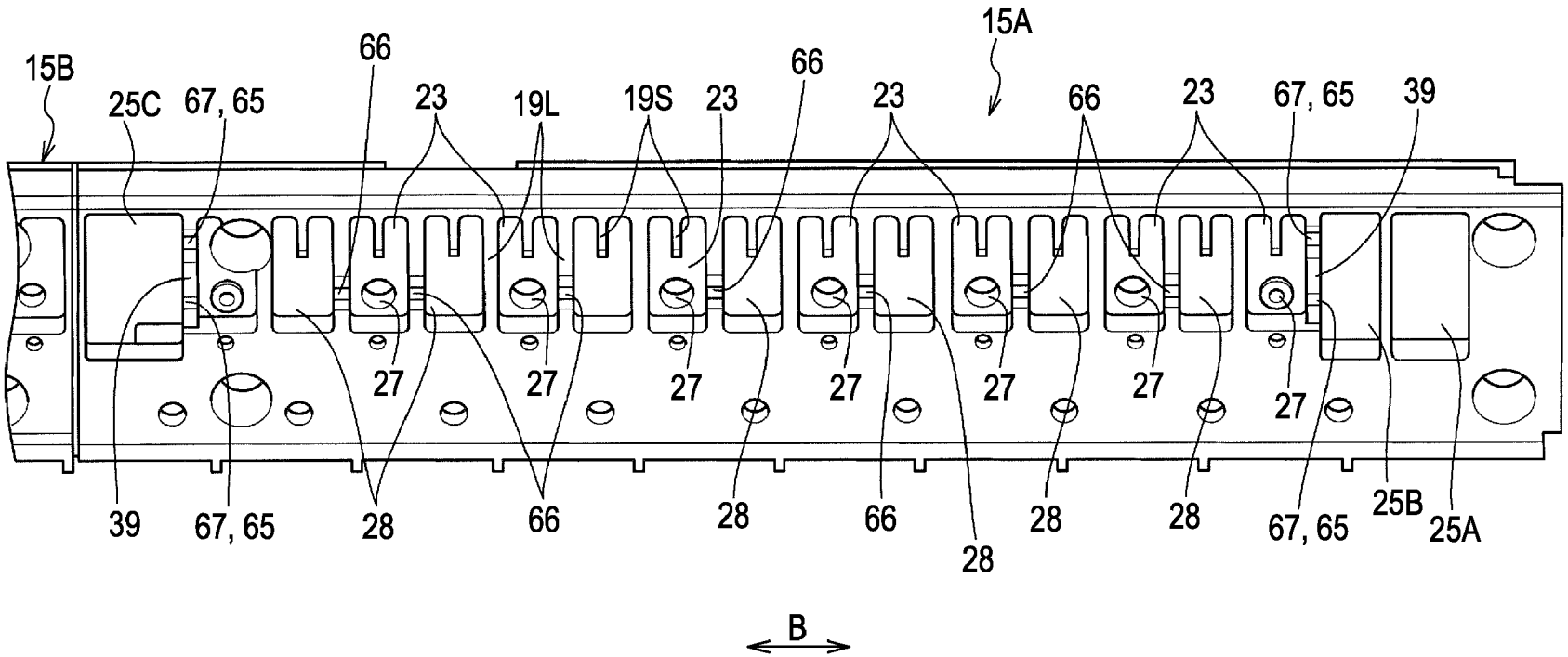
FIG. 15 is a plan view illustrating a reference-side sheet support unit according to still another embodiment of the invention.
Figure 16:
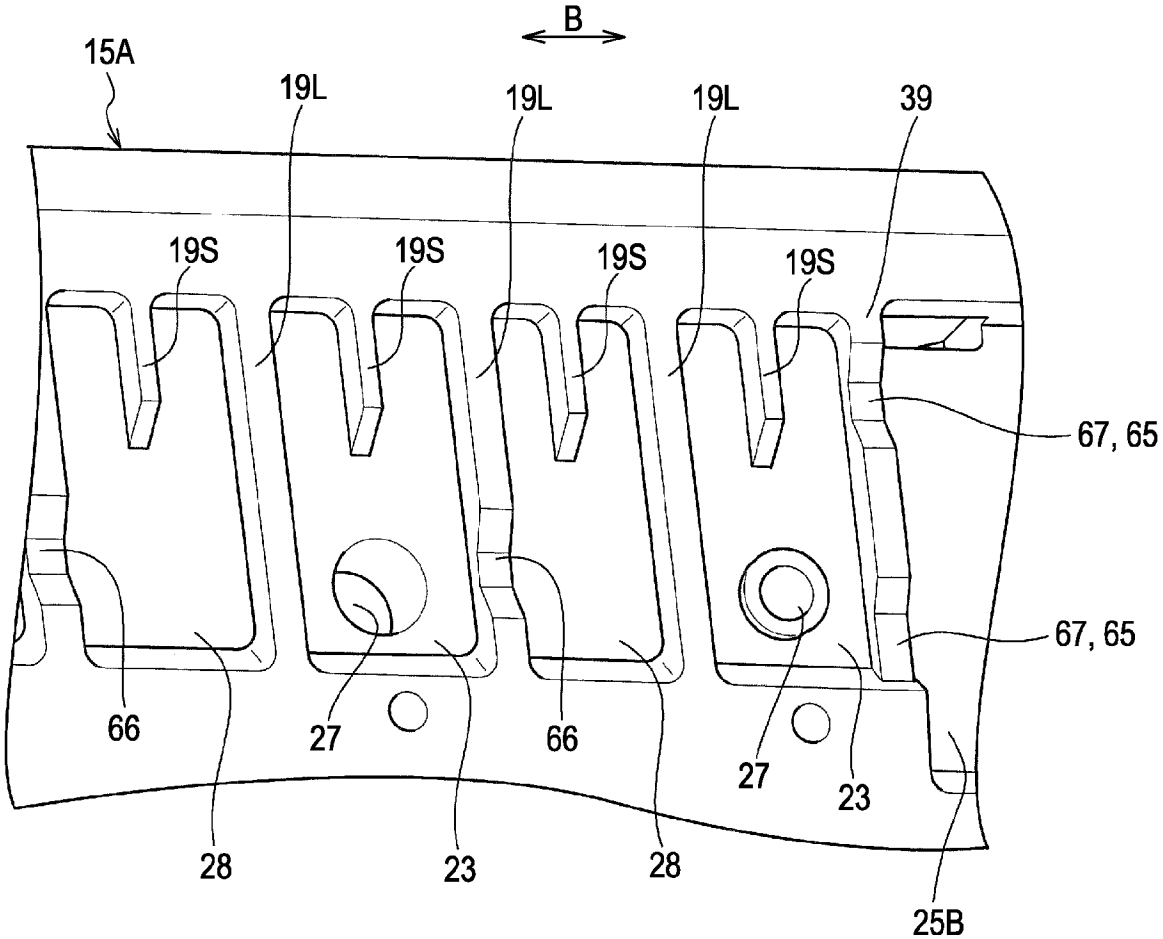
FIG. 16 is an enlarged perspective view illustrating a part of the reference-side sheet support unit according to still another embodiment of the invention.

Embodiment 5 (See FIGS. 15 and 16)

Embodiment 5 of the invention will be described with reference to FIGS. 15 and 16.

FIG. 15 is a plan view illustrating the reference-side sheet support unit 15A according to Embodiment 5. FIG. 16 is an enlarged perspective view illustrating a part of the reference-side sheet support unit 15A according to Embodiment 5.

Since the individual-side sheet support unit 15B in the sheet support units 15 of the above-described embodiment has the same configuration as that of the above-described embodiment, the illustration and description are omitted. The same reference numerals are given to the same constituent elements as those of the above-described embodiment, and the detailed description is omitted.

The plurality of suction grooves 23 (second recess portions) and non-suction grooves 28 (third recess portions), in which a negative pressure space is formed therein when the sheet P is supplied, are formed in the reference-side sheet support unit 15A according to this embodiment. More specifically, in the reference-side sheet support unit 15A according to this embodiment, the plurality of suction grooves 23 and non-suction grooves 28 are alternately formed in the width direction B. As described above, the suction hole 27 is formed in the suction groove 23. On the other hand, the suction hole 27 is not formed in the non-suction groove 28. A second communication passage 66 applying some of the suction force generated in the suction hole 27 of the suction groove 23 to the non-suction groove 28 is formed in each support rib 19L (partition wall) partitioning the suction groove 23 and the non-suction groove 28. That is, some of the suction force is applied to the non-suction groove 28 via the second communication passage 66.

In the sheet support unit 15 with this configuration according to this embodiment, it is possible to decrease the number of suction holes 27 formed in the sheet support unit 15, while enabling the necessary suction force to be applied to the sheet P supported by the sheet support unit 15 with good balance. Accordingly, it is possible to prevent the ink from flowing into the ink jet printer 1 via the suction holes 27 when the ink is erroneously ejected to the sheet support unit 15.

What is claimed is:

1. A printing apparatus comprising:

a printing medium support unit supporting a printing medium supplied to a print execution area and guiding the printing medium being transported, wherein the printing medium support unit includes:

a support portion supporting the printing medium supplied to the print execution area and defining a predetermined gap between a print head and the support portion;

a suction hole disposed in a width direction of the printing medium and adsorbing and supporting the printing medium on the support portion by applying a suction force to the printing medium;

a first recess portion disposed at a position corresponding to a position at an edge of the printing medium of a size which is supposed to be used, receiving ink discarded upon executing marginless printing, and having an ink discharge port; and a first communication passage applying some of the suction force to the first recess portion in a passage independent from the ink discharge port, wherein the suction hole is formed in a second recess portion in which a negative pressure space is formed when the printing medium is supplied, and wherein the first communication passage is formed in a partition wall partitioning the first and second recess portions.

2. The printing apparatus according to claim 1, wherein the printing medium support unit further includes a third recess portion in which a negative pressure space is formed when the printing medium is supplied, and wherein a second communication passage applying some of the suction force to the third recess portion is formed in a partition wall partitioning the second and third recess portions.

3. The printing apparatus according to claim 1, wherein the first recess portion includes an ink discharge port discharging the discarded ink from the first recess portion and a recovery passage guiding the ink discharged in the ink discharge port to a waste liquid tank, and wherein when the printing medium is supplied to a region of the first recess portion, the printing medium defines enclosed spaces among the inside of the first recess portion, the recovery passage, and the waste liquid tank by at least partially covering one or more of the first recess portion, the recovery passage, and the waste liquid tank.

4. The printing apparatus according to claim 3, wherein the enclosed spaces are defined independently in each first recess portion.

5. The printing apparatus according to claim 3, wherein the waste liquid tank is filled with an ink absorbing member absorbing the ink guided from the recovery passage, and wherein the enclosed spaces defined in the waste liquid tank are formed in a void portion between an ink introduction portion connected to the recovery passage and the ink absorbing member.

6. The printing apparatus according to claim 3, wherein the waste liquid tank is disposed in a cartridge type waste liquid box detachably mounted on a printing apparatus main body, and wherein a connection structure connecting the waste liquid tank and the recovery passage to each other in an enclosed state is disposed in a connection portion of the waste liquid tank and the recovery passage.

7. The printing apparatus according to claim 6, wherein the connection structure includes:

an inclination connection portion of which a joint surface is formed as an inclination surface and which is disposed at a discharge end of the recovery passage;

an inclination joint portion which is disposed in an ink introduction portion of the waste liquid tank in which a joint surface is formed as the inclination surface so as to join to the joint surface of the inclination connection portion.

8. A printing apparatus comprising:

a printing medium support unit supporting a printing medium supplied to a print execution area and guiding the printing medium being transported, wherein the printing medium support unit includes:

a support portion supporting the printing medium supplied to the print execution area and defining a predetermined gap between a print head and the support portion;

a suction hole disposed in a width direction of the printing medium and adsorbing and supporting the printing medium on the support portion by applying a suction force to the printing medium;

a first recess portion disposed at a position corresponding to a position at an edge of the printing medium of a size which is supposed to be used and receiving ink discarded upon executing marginless printing; and a first communication passage disposed in an entrance of the first recess portion facing the printing medium and applying some of the suction force to the first recess portion, wherein the suction hole is formed in a second recess portion in which a negative pressure space is formed when the printing medium is supplied, and wherein the first communication passage is formed in a partition wall partitioning the first and second recess portions.

9. The printing apparatus according to claim 8, wherein the printing medium support unit further includes a third recess portion in which a negative pressure space is formed when the printing medium is supplied, and wherein a second communication passage applying some of the suction force to the third recess portion is formed in a partition wall partitioning the second and third recess portions.

10. The printing apparatus according to claim 8, wherein the first recess portion includes an ink discharge port discharging the discarded ink from the first recess portion and a recovery passage guiding the ink discharged in the ink discharge port to a waste liquid tank, and wherein when the printing medium is supplied to a region of the first recess portion, the printing medium defines enclosed spaces among the inside of the first recess portion, the recovery passage, and the waste liquid tank by at least partially covering one or more of the first recess portion, the recovery passage, and the waste liquid tank.

11. The printing apparatus according to claim 10, wherein the enclosed spaces are defined independently in each first recess portion.

12. The printing apparatus according to claim 10, wherein the waste liquid tank is filled with an ink absorbing member absorbing the ink guided from the recovery passage, and wherein the enclosed spaces defined in the waste liquid tank are formed in a void portion between an ink introduction portion connected to the recovery passage and the ink absorbing member.

13. The printing apparatus according to claim 10, wherein the waste liquid tank is disposed in a cartridge type waste liquid box detachably mounted on a printing apparatus main body, and wherein a connection structure connecting the waste liquid tank and the recovery passage to each other in an enclosed state is disposed in a connection portion of the waste liquid tank and the recovery passage.

14. The printing apparatus according to claim 13, wherein the connection structure includes:

an inclination connection portion of which a joint surface is formed as an inclination surface and which is disposed at a discharge end of the recovery passage;

an inclination joint portion which is disposed in an ink introduction portion of the waste liquid tank in which a joint surface is formed as the inclination surface so as to join to the joint surface of the inclination connection portion; and a seal member which is disposed in either or both of the inclination connection portion and the inclination joint portion.

* * * * *